United States Patent [19]

Riollet et al.

[11] 4,335,995

[45] Jun. 22, 1982

[54] SET OF BLADES FOR A TURBINE AND A TURBINE WHICH INCLUDES SUCH A SET OF BLADES

[75] Inventors: Gilbert Riollet, Paris; Raymond Bessay, Belfort, both of France

[73] Assignee: Alsthom-Atlantique, Paris, France

[21] Appl. No.: 196,792

[22] PCT Filed: Oct. 4, 1979

[86] PCT No.: PCT/FR79/00089

§ 371 Date: Jun. 5, 1980

§ 102(e) Date: May 30, 1980

[87] PCT Pub. No.: WO80/00728

PCT Pub. Date: Apr. 17, 1980

[30] Foreign Application Priority Data

Oct. 5, 1978 [FR] France ..... 78 28459

[51] Int. Cl.[3] ..... F01D 5/14; F04D 29/68

[52] U.S. Cl. ..... 415/144; 415/168; 415/DIG. 1

[58] Field of Search ..... 415/144, 168, DIG. 1, 415/115

[56] References Cited

U.S. PATENT DOCUMENTS 2,291,828 8/1942 New ..... 415/115
4,146,352 3/1979 Yasugahira et al. ..... 415/144

FOREIGN PATENT DOCUMENTS 1106027 5/1961 Fed. Rep. of Germany .
341014 7/1904 France .

*Primary Examiner*—Robert E. Garrett
*Attorney, Agent, or Firm*—Sughrue, Mion, Zinn, Macpeak & Seas

[57] ABSTRACT

A set of blades for a turbine which includes a group of blades disposed between an upper plate (12) and a lower plate (11), the group of blades defining a group of passages (3). The set of blades includes ducts (13,23) in the upper plate (12) and/or in the lower plate (11), said ducts leading, from one end situated at a point in the neighborhood of the concave surfaces of the blades, at the constriction (10) of the passage, to its other end located at a point downstream from the set of blades. A reduction in the high pressure on the concave surfaces in only two zones, one vertically above the lower plate (12) and the other vertically below the upper plate (11), reduces secondary losses, while the distribution of the pressure remains optimum in the part of the passages where the flow is non-turbulent.

9 Claims, 4 Drawing Figures

SET OF BLADES FOR A TURBINE AND A TURBINE WHICH INCLUDES SUCH A SET OF BLADES

FIELD OF THE INVENTION

The present invention relates to a set of blades for a turbine which includes firstly a group of blades disposed between an upper plate and a lower plate which therefore define a group of passages along which a turbine feed fluid flows, each passage being delimited by the concave surface of one blade and the convex surface of the blade next to it and by the lower plate and the upper plate and secondly, at least one duct in the upper plate and/or least one duct in the lower plate, one end of such a duct opening into a passage and the other end opening at a point located downstream from said set of blades.

BACKGROUND OF THE INVENTION

Such a set of blades is described in German Pat. No. 893,649.

It is known that in a given passage, at points which are sufficiently far from the walls of the passage, the stream lines follow paths which are substantially parallel to the walls of the passage formed by the concave and convex surfaces of the blades. At all points along the path, the centrifugal force which is exerted on a particle is balanced by the pressure forces. The result of this is, generally, that the concave surface of the blade is subjected to a higher pressure than is the convex surface of the blade which delimits the passage.

It is also known that in the boundary layer near the lower plate and upper plate, the speed of the fluid is low; it follows that the pressure forces are no longer balanced and the stream lines are curves perpendicular to the isobars and follow paths of considerable slippage in each passage from the concave surface to the convex surface as is well known to the person skilled in the art (see, for example, the article in the November 1941 French issue of the Brown Boveri review—see p. 356 to 361 and, in particular, FIGS. 2 and 3).

The slippage generates a counter-clockwise eddy against the upper plate of the passage and a clock-wise eddy against the lower plate as seen by an observer placed downstream from the set of blades.

These disturbances cause important losses known as secondary losses and the smaller the ratio between the height of the blades and the chord, the more the efficiency of a set of blades is reduced.

German Pat. No. 893,649 provides for a reduction in secondary losses by providing ducts which discharge into the passages and have openings located in the mid portion of the upper plate at an equal distance from the concave surface of one blade and the concave surface of the blade next to it which delimit a passage. The diameter of said duct is large enough (with respect to the dimensions of the passage) to allow the boundary layer to be aspirated.

Aspirating said boundary layer makes it possible to reduce disturbance greatly, but it does not reduce secondary losses as much; indeed, the aspirated fluid no longer has any effect in the passage from which it was aspirated and it causes disturbance in the fluid which passes through the following set of blades through which it is reinjected.

In the invention, on the contrary, only a small portion of the boundary layer is aspirated to prevent slippage thereof and thereby to make the fluid of the boundary layer useful.

SUMMARY OF THE INVENTION

The set of blades according to the invention is characterized in that for each duct the end which opens into the passage is located in the neighbourhood of the concave surface of the blade which delimits said passage and opening to the constriction thereof.

Said end therefore discharges at the point of the passage which is at the maximum pressure.

Since said point communicates via the duct with a point located downstream from the set of blades (and therefore at a lower pressure) the pressure at said point decreases. This reduces slippage of the boundary layer, thereby making said layer useful in the passage considered.

In the case where the set of blades includes no upper plate (this is the case with some moving blades) or no bottom plate (this is the case with some fixed blades), ducts are then provided only in the lower plate (in the case of said moving blades) or in the upper plate (in the case of said fixed blades).

The invention also relates to a turbine which includes a set of moving blades followed by a set of fixed blades, each of the sets of blades including a group of blades disposed between an upper plate and a lower plate and thereby defining a group of passages through which the turbine feed fluid flows, each passage being delimited by the concave surface of one blade and the convex surface of the blade next to it and by the lower plate and the upper plate, the set of fixed blades including, for each blade, at least one duct in the upper plate, said duct opening at one end into a passage and at the other end at a point located downstream from said set of blades, said turbine including, level with the set of moving blades, sealing rims which surround the upper plate of said set of blades, characterized in that for each duct, the end which opens into the duct is located in the neighbourhood of the concave surface of the blade which delimits said passage and at the constriction thereof and therefore at the point of the passage where the pressure is maximum.

Therefore, the leakage flow which passes along the sealing rims associated with the following set of moving blades flows through ducts in the upper plate of the preceding set of fixed blades.

If the holes are made to such a size that their discharge rate is less than or equal to the flow rate of the leakage which passes along the sealing rims associated with the following set of moving blades, the entire gain due to the improvement in the secondary losses is thereby safeguarded.

The invention further relates to a turbine which includes a set of moving blades followed by a set of fixed blades, each of the sets of blades including a group of blades disposed between an upper plate and a lower plate and thereby defining a group of passages through which the turbine feed fluid flows, each passage being delimited by the concave surface of one blade and the convex surface of the blade next to it and by the lower plate and the upper plate, the set of moving blades including, for each blade, at least one duct in the upper plate, said duct opening at one end into a passage and at the other end at a point located downstream from said set of blades, said turbine including, level with the set of fixed blades, sealing rims which are surrounded by the upper plate of said set of blades, characterized in that for each duct, the end which opens into the duct is located in the neighbourhood of the concave surface of the blade which delimits said passage at the level of the construction thereof and therefore at the point of the passage where the pressure is maximum.

If the ducts are made to such a size that their discharge rate is less than or equal to the flow rate of the leakage which passes along the sealing rims associated with the following set of fixed blades, the entire gain due to the improvement of the secondary losses is thereby safeguarded.

The following description given with reference to the accompanying drawings will make it easier to understand how the invention can be implemented.

DESCRIPTION OF THE PRIOR ART AND PREFERRED EMBODIMENT

Figure 1:
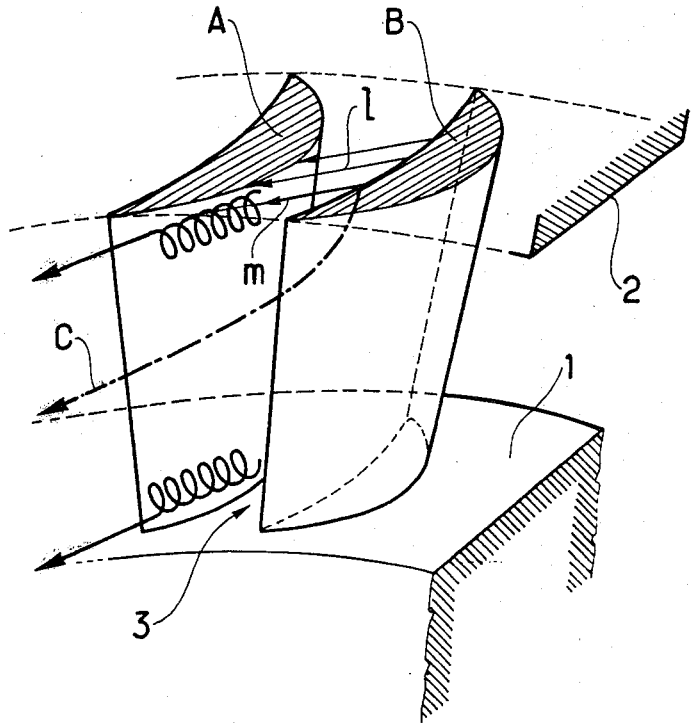
FIG. 1 (PRIOR ART)
FIG. 1 is a perspective view which illustrates part of the set of blades of a conventional turbine.

FIG. 1 illustrates two blades A and B which form a part of a turbine and whose roots are fixed to a lower plate 1 while their heads are fixed to an upper plate 2. The lower plate and the upper plate are usually cylindrical or frustoconical surfaces.

A passage 3 is delimited by the concave surface of the blade B, the convex surface of the blade A, the lower plate, and the upper plate.

Fluid far from the walls of the passage flows smoothly along streamlines such as (c). In contrast, stream lines of fluid which come into contact with the upper plate and the lower plate are orthogonal to the isobars and flow in the directions shown (l) and (m), then begin to be turbulent as soon as they strike the convex surface of the blade (A).

Figure 2:
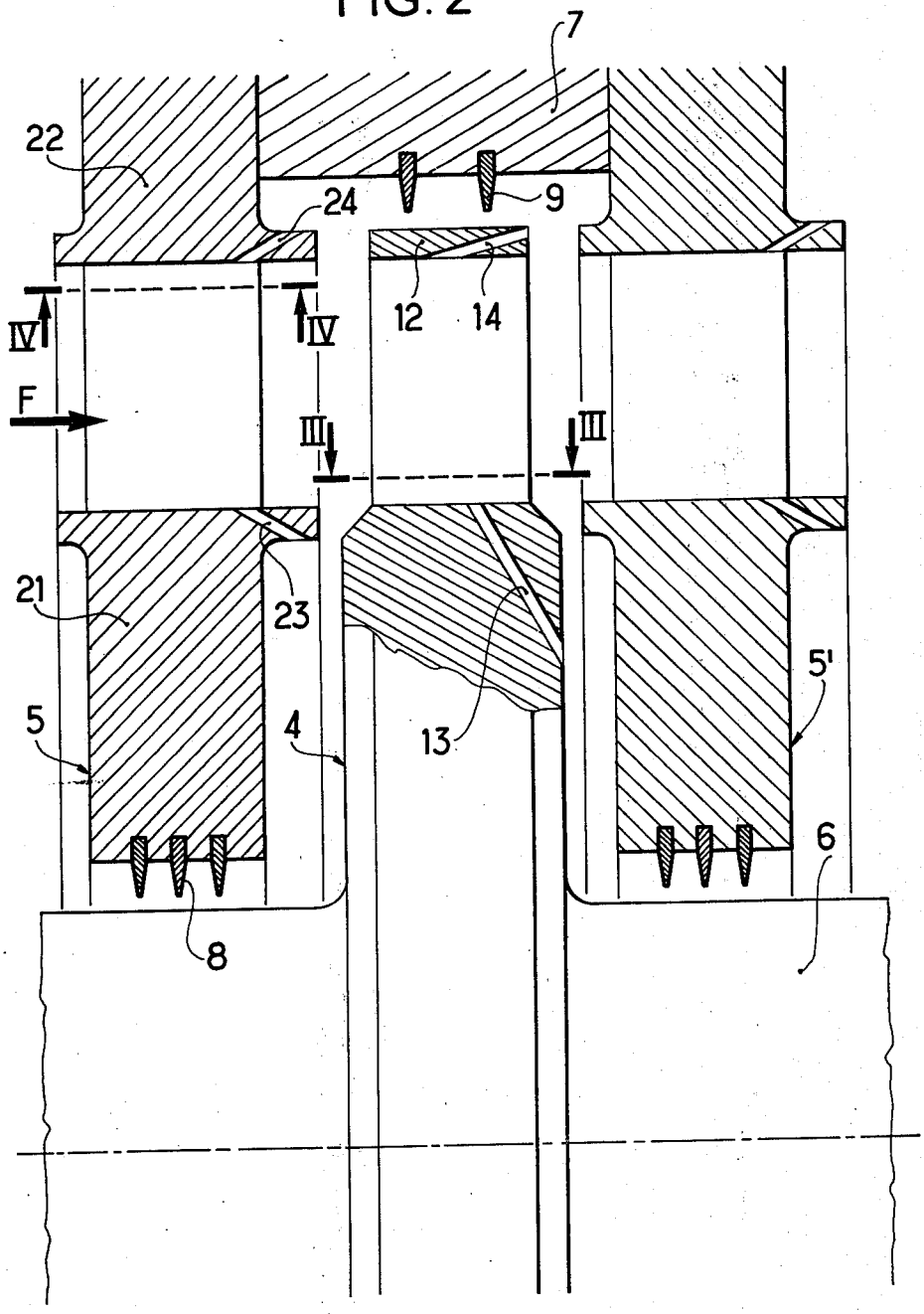
FIG. 2 is an axial cross-section of a turbine which includes sets of blades in accordance with the invention.

FIG. 2 illustrates an axial cross-section of a turbine fitted with sets of fixed and moving blades in accordance with the invention. In general, each set of moving blades 4 is located between two sets of fixed blades 5. The direction of fluid flow is shown by an arrow F.

The sets of moving blades 4 are integral with the rotor 6, while the sets of fixed blades 5 and 5' are integral with the stator 7.

In the neighbourhood of the rotor 6, the sets of fixed blades 5 are fitted with sealing rims 8 which reduce leakage between the rotor 6 and the sets of fixed blades 5. Likewise, in the neighbourhood of the sets of moving blades, the stator 7 is fitted with sealing rims 9 which reduce leakage between the stator 7 and the upper plate 12 of the set moving blades 4.

Figure 3:
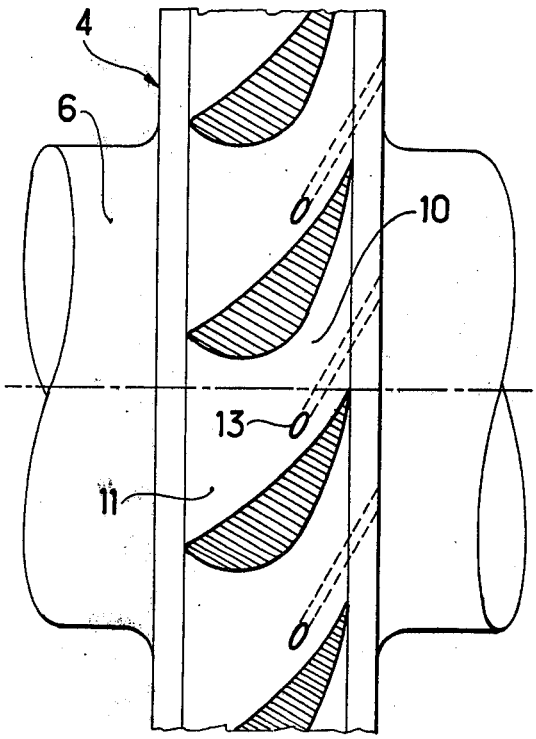
FIG. 3 is a transversal cross-section, seen from above, of a set of moving blades in accordance with the invention.

For each blade 4 of the set of moving blades, a duct 13 is provided in the lower plate 11, between a point downstream of the blades 4 (see FIGS. 2 and 3) and a point in the neighbourhood of the concave surface of the blade and opening to the constriction 10 of the passage delimited by said concave surface.

Also, for each blade 4 of the set of moving blades, a duct 14 is provided in the upper plate 12, between a point downstream of the set of blades 5 (see FIG. 2) and a point in the neighbourhood of the concave surface of the blade and opening to the constriction of the passage delimited by said concave surface.

The neck or constriction of the passage is the region thereof where the distance between the concave surface and the convex surface is the shortest.

For each blade of the set of fixed blades, a duct 23 is provided in the lower plate 21 and starts at a point in the neighborhood of the concave surface of the blade opening to the neck of the passage delimited by said concave surface and ends downstream from the set of blades 5 (see FIG. 2).

Figure 4:
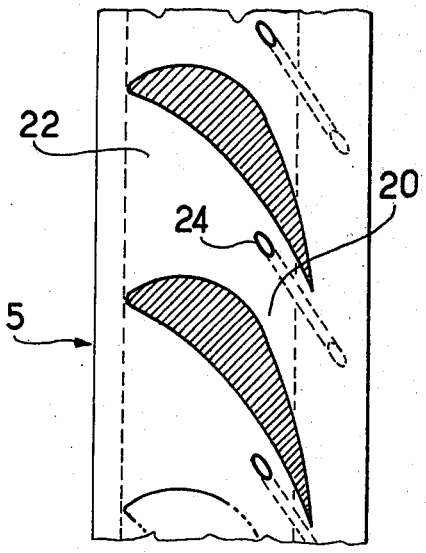
FIG. 4 is a transversal cross-section seen from below, of a set of fixed blades in accordance with the invention.

Also, for each blade of the set of fixed blades, a duct 24 is provided in the upper plate 22 between a point in the neighborhood of the concave surface of the blade opening to the neck 20 of the passage delimited by said concave surface and a point downstream from the set of blades 5 (see FIGS. 2 and 4).

As shown in the drawings, not only do ducts 23, 24 start at a point in the neighborhood (in proximity) of the concave surface of given blades, but as such, the ducts open in the passages at positions remote from the convex surface of adjacent blades defining those passages.

The flow of fluid along the ducts 24 constitutes the fluid leaking between the sealing rims 9 and the upper plate 12 of the following set of moving blades 4 and preferably the flow rate in the ducts 24 is chosen less than or equal to the leakage rate between the sealing rims 9 and the upper plate 12. Likewise, the flow of fluid along the ducts 13 constitutes the fluid leaking between the sealing rims of the following set of fixed blades and the rotor and preferably the flow rate in the ducts 13 is chosen less than or equal to the leakage rate between the sealing rims and the rotor.

The ducts between one point of the lower plate and/or of the upper plate in the neighbourhood of the concave surface of the blades and opening to the constriction of the passage delimited by the concave surface and a point located in a low-pressure chamber constituted by the portion located downstream from the blades make it possible to lower the high pressure in the neighbourhood of the concave surfaces of the blades adjacent the lower plate and/or upper plate.

It is self-evident that the turbine in accordance with the invention could be provided with such ducts only on the sets of fixed blades or only on the sets of moving blades in the lower plate and/or upper plate of these sets of blades.

Further, these ducts could be associated with only some blades of the same set.

We claim:

1. A set of blades for a turbine, said set including an upper plate and a lower plate and a group of blades disposed between said upper plate and said lower plate and which therefore define a group of passages along which a turbine feed fluid flows, each passage being delimited by the concave surface of one blade and the convex surface of the blade next to it and by the lower plate and the upper plate and secondly, at least two ducts associated with each blade, one in the upper plate and the other in the lower plate, one end of each of these ducts opening into a passage and the other end of each of these ducts opening at a point located downstream from said set of blades, the improvement wherein, for each duct (13, 14, 23, 24), the duct end which opens into the passage is located in proximity to the concave surface of one blade which delimits said passage, and remote from the convex surface of the other blade delimiting that passage, and at the flow constriction (10, 20) at the level of maximum flow constriction between blades.

2. A set of blades for a turbine, said set including firstly an upper plate and a lower plate, a group of blades disposed between said upper plate and said lower plate which therefore defines a group of passages along which a turbine feed fluid flows, each passage being delimited by the concave surface of one blade and the convex surface of the blade next to it and by the lower plate and the upper plate and secondly, ducts in the upper plate which are associated with the blades, one end of each of said ducts opening into a passage and the other end of each of said ducts opening at a point located downstream from said set of blades, the improvement wherein, for each duct (14, 24), the duct end which opens into the passage is located in proximity to the concave surface of one blade which delimits said passage at the level of the maximum constriction thereof and remote from the convex surface of the other blade deliminating that passage.

3. A set of blades for a turbine, said set including firstly an upper plate and a lower plate, a group of blades disposed between said upper plate and said lower plate which therefore define a group of passages along which a turbine feed fluid flows, each passage being delimited by the concave surface of one blade and the convex surface of the blade next to it and by the lower plate and the upper plate and secondly, ducts in the lower plate which are associated with the blades, one end of each of said ducts opening into a passage and the other end of each of said ducts opening at a point located downstream from said set of blades, the improvement wherein, for each duct (13, 23), the duct end which opens into the passage is located in proximity to the concave surface of one blade which delimits said passage at the level of the maximum constriction (10, 20) thereof, and remote from the convex surface of the other blade delimiting that passage.

4. A set of moving blades for a turbine, said set including firstly an upper plate, a lower plate, a group of blades assembled on said lower plate and which therefore define a group of passages along which a turbine feed fluid flow, each passage being delimited by the convex surface of one blade and the concave surface of the blade next to it and by the lower plate and the upper plate and secondly, ducts in the lower plate which are associated with the blades, one end of each of said ducts opening into a passage and the other end of each of said ducts opening at a point located downstream from said set of blades, the improvement wherein, for each duct (13), the duct end which opens into the passage is located in proximity to the concave surface of one blade which delimits said passage, at the level of the maximum constriction (1)) thereof and remote from the convex surface of the other blade delimiting said passage.

5. A set of blades for a turbine, said set including firstly an upper plate, a lower plate, a group of blades assembled on said upper plate and which therefore define a group of passages along which a turbine feed fluid flows, each passage being delimited by the concave surface of one blade and the convex surface of the blade next to it and by the lower plate and the upper plate and secondly, ducts in the lower plate which are associated with the blades, one end of each of said ducts opening into a passage and the other end of each of said ducts opening at a point located downstream from said set of blades, the improvement wherein for each duct (24), the duct end which opens into the passage is located in proximity to the concave surface of one blade which delimits said passage and remote from the convex surface of the other blade delimiting that passage, and at the level of the maximum flow constriction between blades.

6. A turbine including a set of moving blades having opposite concave and convex surfaces followed by a set of fixed blades, each of the sets of blades including an upper plate, a lower plate, a group of blades disposed between said upper plate and said lower plate and thereby defining a group of passages through which the turbine feed fluid flows, each passage being delimited by the concave surface of one blade and the convex surface of the blade next to it and by the lower plate and the upper plate, the set of fixed blades including, for each blade, at least one duct in the upper plate, said duct opening at one end into a passage and at the other end at a point located downstream from said set of blades, said turbine including, level with the set of fixed blades, sealing rims which surround the upper plate of said set of blades, the improvement wherein, for each duct (24), the duct end which opens into the duct is located in the neighbourhood of the concave surface of the blade which delimits said passage, at the neck (20) thereof.

7. A turbine according to claim 6, wherein the passages (24) have a discharge less than or equal to the leakage discharge which passes along the sealing rims (9) associated with the following set of moving blades.

8. A turbine which includes a set of moving blades followed by a set of fixed blades, each of the sets of blades including an upper plate, a lower plate, a group of blades having opposite concave and convex surfaces and disposed between said upper plate and said lower plate and thereby defining a group of passages through which the turbine feed fluid flows, each passage being delimited by the concave surface of one blade and the convex surface of the blade next to it and by the lower plate and the upper plate, the set of moving blades including, for each blade, at least one duct in the upper plate, said duct opening at one end into a passage and at the other end at a point located downstream from said set of blades, said turbine including, level with the set of moving blades, sealing rims which surround the upper plate of said set of blades, the improvement wherein, for each duct (13), the duct end which opens into the duct is located in the neighbourhood of the concave surface of the blade which delimits said passage at the constriction (10) thereof.

9. A turbine according to claim 8, wherein the passages (13) have a discharge less than or equal to the leakage discharge which passes along the sealing rims associated with the following set of fixed blades (5').

* * * * *